US010498092B2

(12) United States Patent
Tseng et al.

(10) Patent No.: US 10,498,092 B2
(45) Date of Patent: Dec. 3, 2019

(54) CONNECTOR WITH OVER-TEMPERATURE AND OVER-CURRENT PROTECTION

(71) Applicant: Polytronics Technology Corp., Hsinchu (TW)

(72) Inventors: Chun Teng Tseng, Miaoli County (TW); David Shau Chew Wang, Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 123 days.

(21) Appl. No.: 15/278,399

(22) Filed: Sep. 28, 2016

(65) Prior Publication Data

US 2017/0125954 A1 May 4, 2017

(30) Foreign Application Priority Data

Nov. 3, 2015 (TW) ..... 104136094 A

(51) Int. Cl.
*H01R 13/66* (2006.01)
*H01R 13/717* (2006.01)

(52) U.S. Cl.
CPC ..... *H01R 13/7175* (2013.01); *H01R 13/6616* (2013.01); *H01R 13/6666* (2013.01)

(58) Field of Classification Search
CPC ..... H01R 13/7175; H01R 13/6616; H01R 13/713; H01R 24/60; H01R 2107/00; H01R 13/717; H01R 9/2441; H01R 13/6666
USPC ..... 439/620.26, 620.21, 488, 490, 620.01, 439/620.08
See application file for complete search history.

(56) References Cited

U.S. PATENT DOCUMENTS 5,493,101 A * 2/1996 Innes ..... H02H 3/025 219/481
7,701,322 B2 * 4/2010 Wang ..... H01C 7/021 338/22 R
8,044,763 B2 * 10/2011 Wang ..... H01C 1/1406 338/22 R
8,436,739 B2 * 5/2013 Elms ..... G01R 31/3272 340/391.1

(Continued)

FOREIGN PATENT DOCUMENTS

CN 202997524 U * 6/2013
CN 203660195 U 6/2014
TW M509495 U 9/2015

*Primary Examiner* — Travis S Chambers
(74) *Attorney, Agent, or Firm* — Muncy, Geissler, Olds & Lowe, P.C.

(57) ABSTRACT

A connector comprises a terminal and a layered circuit substrate. The layered circuit substrate connects to an end of the terminal, and comprises a PTC material layer, a first electrode layer forming an upper layer of the layered circuit substrate, and a second electrode layer forming a lower surface of the layered circuit substrate. The PTC material layer is disposed between the first and second electrode layers. The first and second electrode layers comprise first and second electrode pads which connect to a power supply, and the PTC material layer electrically connects to the first and second electrode pads to form an electrically conductive path in which the PTC material layer serves as a PTC resistor in series connection between the first and second electrode pads. When over-current or over-temperature occurs in the electrically conductive path, the PTC resistor will trip to a high resistance state.

8 Claims, 8 Drawing Sheets

(56) References Cited

U.S. PATENT DOCUMENTS

| | | | | |
|---|---|---|---|---|
| 8,525,425 | B1 * | 9/2013 | Roudeski | H05B 33/089 315/185 R |
| 8,777,666 | B2 * | 7/2014 | Golko | H01R 13/6594 439/607.34 |
| 9,007,166 | B2 * | 4/2015 | Tseng | H01C 7/02 338/22 R |
| 9,041,507 | B2 * | 5/2015 | Wang | H01C 7/027 338/13 |
| 9,112,348 | B2 * | 8/2015 | Tseng | H02H 9/026 |
| 2011/0080432 | A1 * | 4/2011 | Nakazawa | G09G 3/3426 345/690 |
| 2012/0043884 | A1 * | 2/2012 | Lee | F21V 3/02 315/32 |
| 2015/0380858 | A1 * | 12/2015 | Kao | H01R 13/658 439/620.22 |

* cited by examiner

CONNECTOR WITH OVER-TEMPERATURE AND OVER-CURRENT PROTECTION

BACKGROUND OF THE INVENTION (1) Field of the Invention

The present application relates to a connector, and more specifically, to a connector with over-temperature and over-current protections.

(2) Description of the Related Art

With the development of mobile apparatuses, users require more functions. As such, electricity volume of a battery of a mobile apparatus becomes larger to meet the need of a larger screen size of the mobile apparatus, and high efficient quick charge technology is prevalent gradually. Therefore, high power battery charging is demanded. During high power charging, connectors, e.g., USB, microUSB, or USB Type-C, serving as input/output interfaces for charging may be blown due to micro short-circuit. In charging with a large current, with the increase of hot-plugging times, unexpected bodies such as hairs, metal scraps, liquids or coffee dregs may enter the connectors to incur micro short-circuit. Micro short-circuit may also occur if connectors are damaged or deformed due to plugging on a slant or violent plugging. Micro short-circuit does not meet the criteria to trigger short-circuit protection, and thus a battery charger continuously outputs power which transforms into heat to heat up the connector and the battery charger. As a consequence, the connector or the battery charger may have a malfunction or be burned out. These problems incur safety concerns during battery charging, and therefore it is highly demanded to effectively resolve these problems.

Nowadays, USB cables are commonly used for data transmission and battery charging. As mentioned above, it is more likely to cause malfunction or burnout of the USB cables because of large charging current and frequent plugging. Most USB cables are not provided with protection devices. Even if the USB cables are provided with protection devices, they are not able to sense micro short-circuit to trigger current reduction. Therefore the USB cables, the associated connectors or electronic apparatuses may suffer breakdown or burnout issues, raising safety concerns to the users.

SUMMARY OF THE INVENTION

To resolve the problems that protection is not activated when short-circuit or micro short-circuit occurs during battery charging or data transmission, the present invention devises a connector in which a layered circuit substrate can provide over-temperature and over-current protection so as to avoid burnout of the connector or the apparatus connected thereto caused by micro short-circuit.

Conductive composite materials for over-current protection usually have positive temperature coefficient (PTC) characteristic; that is, the resistance of the PTC material remain extremely low at a normal temperature; however when an over-current or an over-temperature occurs in the circuit, the resistance instantaneously increases to a high resistance state (i.e., trip) to diminish the current for circuit protection. When the temperature decreases to room temperature or over-current no longer exists, the PTC conductive composite material returns to low resistance state so that the circuit operates normally again and the PTC conductive composite material can be reused. The present application uses PTC conductive composite material as a core of the layered circuit substrate to provide over-current and/or over-temperature protection.

In accordance with an embodiment of the present application, a connector comprises a terminal and a layered circuit substrate. The layered circuit substrate connects to an end of the terminal, and comprises a PTC material layer, a first electrode layer and a second electrode layer. The first electrode layer forms an upper layer of the layered circuit substrate, and the second electrode layer forms a lower surface of the layered circuit substrate. The PTC material layer is disposed between the first and second electrode layers. The first and second electrode layers comprise first and second electrode pads which connect to power supply, and the PTC material layer electrically connects to the first and second electrode pads to form an electrically conductive path in which the PTC material layer serves as a PTC resistor in series connection between the first and second electrode pads. When over-current or over-temperature occurs in the electrically conductive path, the PTC resistor will trip to a high resistance state.

If the terminal of the connector during battery charging heats up due to over-current, short-circuit, or micro short-circuit, the heat can be rapidly transferred to the PTC material layer, inducing high resistance of the PTC resistor to tremendously decrease current flowing therethrough. Accordingly, the connector and the electronic apparatus connected thereto can be prevented from being blown.

In an embodiment, the layered circuit substrate may further comprise a first conductive layer and a second conductive layer. The first conductive layer is formed on a surface of the PTC material layer, and electrically connects to the first electrode pad. The second conductive layer is form on an opposite surface of the PTC material layer, and electrically connects to the second electrode pad.

In an embodiment, the layered circuit substrate may further comprise a first insulating layer and a second insulating layer. For isolation, the first insulating layer is laminated between the first electrode layer and the PTC material layer, and the second insulating layer is laminated between the second electrode layer and the PTC material layer.

In an embodiment, the layered circuit substrate may further comprise a first conductive connecting member and a second conductive connecting member. The first conductive connecting member electrically connects to the first electrode pad and the first conductive layer. The second conductive connecting member electrically connects to the second electrode pad and the second conductive layer.

In an embodiment, the first conductive connecting member penetrates through the first insulating layer and connects to the first electrode pad and the first conductive layer, whereas the second conductive connecting member penetrates through the second insulating layer and connects to the second electrode pad and the second conductive layer.

In an embodiment, the first electrode pad and the second electrode pad are disposed on different sides of the layered circuit substrate.

In an embodiment, the first conductive connecting member and the second conductive connecting member penetrate through the first insulating layer, the PTC material layer and the second insulating layer. The first conductive connecting member connects to the first electrode pad and the first conductive layer, and is isolated from the second conductive layer. The second conductive connecting member connects to the second electrode pad and the second conductive layer, and is isolated from the first conductive layer.

In an embodiment, the first electrode pad and the second electrode pad are disposed on a same side of the layered circuit substrate.

In an embodiment, the connector may further comprise an alarm device which is connected to the PTC resistor in parallel. When the PTC resistor trips to high resistance, the current will shunt to the alarm device to generate an alarm message.

In an embodiment, the alarm device comprises an LED device which lights if abnormal events occur.

In an embodiment, the alarm device comprises two LED devices in parallel connection. The two LED devices have opposite polarities and are able to emit lights when abnormal events occur.

In an embodiment, the alarm device comprises a beeper which sounds if abnormal events occur.

With the increase of battery electricity volume and quick charge applications, high power of a battery charger is needed, i.e., the working current and voltage increase. In accordance with the present application, the PTC material layer as the core of the entire layered circuit substrate has very large effective area to reduce its resistance value. In comparison with a known manner to surface-mount a PTC device onto a circuit board, the present application can save space and the PTC material layer obtains larger effective area to reduce resistance. Therefore, the PTC material layer can use high-voltage withstanding material to enhance practicability and applicability. Moreover, sellers can easily identify whether buyers use charging cables coming with the products of the sellers by inspecting whether PTC layered circuit substrates are used in the connectors, so as to avoid disputes of improper use after sale.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
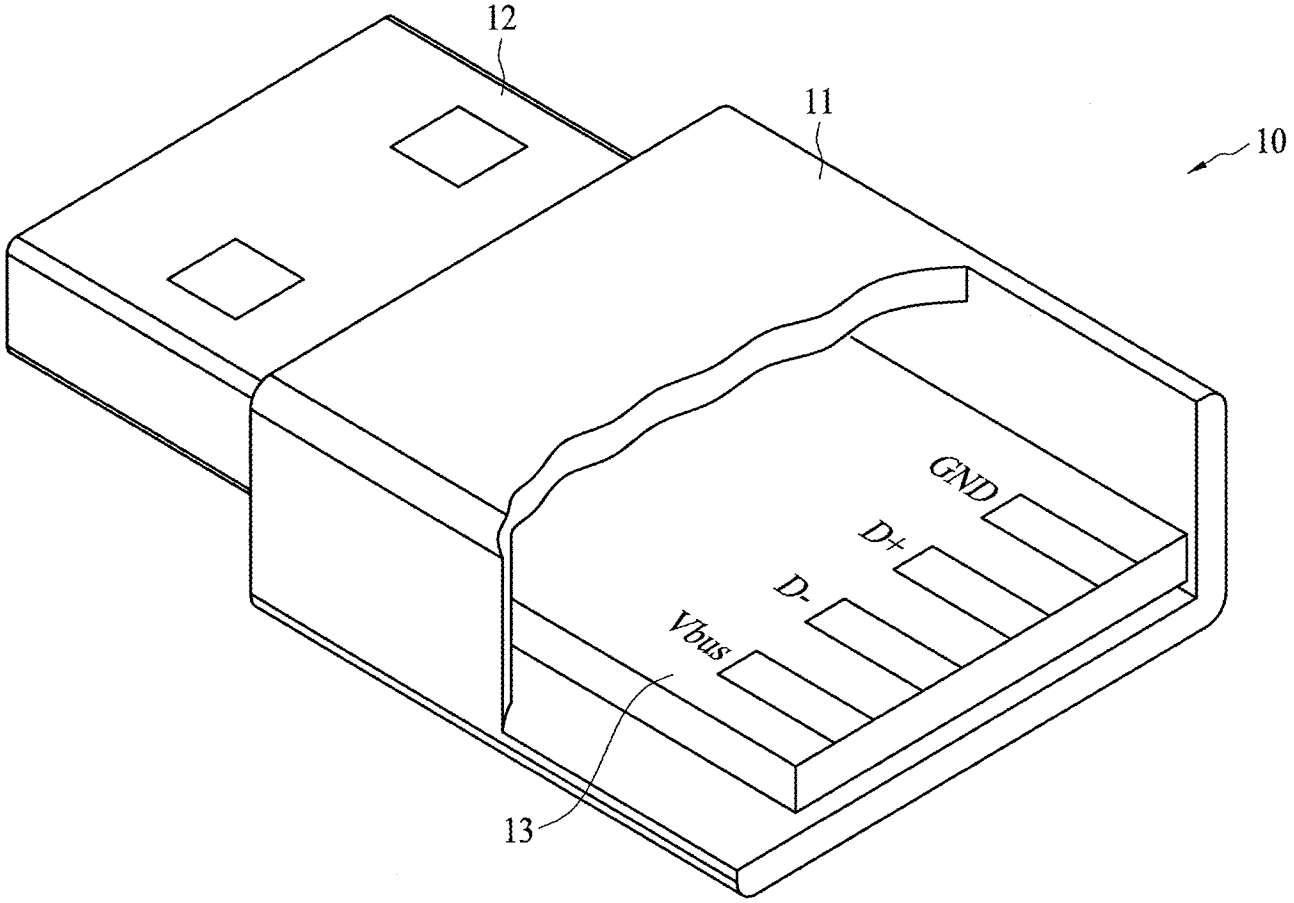
FIG. 1 shows a connector in accordance with an embodiment of the present application.

FIG. 1 shows a connector in accordance with an embodiment of the present application. The connector is exemplified by but not limited to a USB 2.0 connector. The connector 10 comprises a housing 11, a terminal 12 and a layered circuit substrate 13. The layered circuit substrate 13 has an end connecting to the terminal 12, and another end connecting to an electric wire or cable (not shown). The terminal 12 has plural pins electrically connecting to corresponding electrode pads Vbus, D−, D+ and GND of the layered circuit substrate 13. In compliance with USB 2.0 specification, Vbus supplies 5V; D− and D+ transmit data; GND is for grounding. The layered circuit substrate 13 is encompassed and protected by the housing 11, and the housing 11 may be made of insulating material such as plastics.

Figure 2:
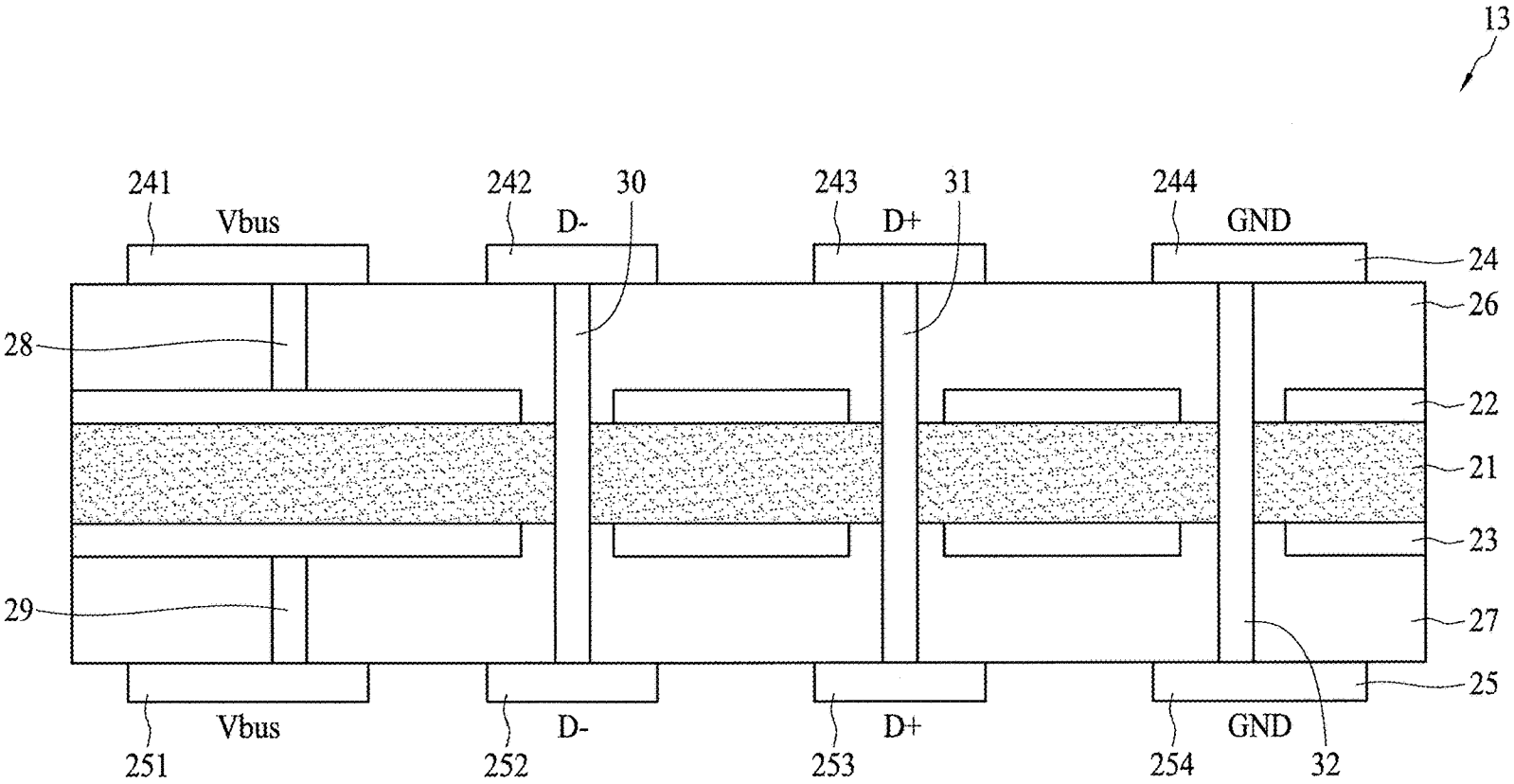
FIG. 2 shows a cross-sectional view of a layered circuit substrate of a connector in accordance with an embodiment of the present application.

FIG. 2 shows a cross-sectional view of the layered circuit substrate 13 in accordance with an embodiment of the present application. The layered circuit substrate is a laminate of multiple material layers. The layered circuit substrate 13 extends horizontally and comprises a PTC material layer 21, a first conductive layer 22, a second conductive layer 23, a first electrode layer 24, a second electrode layer 25, a first insulating layer 26 and a second insulating layer 27. The first conductive layer 22 and the second conductive layer 23 are disposed on the upper and lower surfaces of the PTC material layer 21, respectively. That is, the PTC material layer 21 is laminated between the first and second conductive layers 22 and 23. For isolation, the first insulating layer 26 is disposed between the first conductive layer 22 and the first electrode layer 24, and the second insulating layer 27 is disposed between the second conductive layer 23 and the second electrode layer 25. The first electrode layer 24 forms an upper surface of the layered circuit substrate 13 and divides into electrode pads 241, 242, 243 and 244, e.g., Vbus, D−, D+ and GND, for power supply or data transmission. Similarly, the second electrode layer 25 forms the lower surface of the layered circuit substrate 13 and divides into electrode pads 251, 252, 253 and 254, e.g., Vbus, D−, D+ and GND, respectively. In the first electrode layer 24 and the second electrode layer 25, the portions for power supply, i.e., Vbus, comprise the first electrode pad 241 on the upper surface of the layered circuit substrate 13 and the second electrode pad 251 on the lower surface of the layered circuit substrate 13. A first conductive connecting member 28 penetrates through the first insulating layer 26 and connects to the first electrode pad 241 and the first conductive layer 22, and the second conductive connecting member 29 penetrates through the second insulating layer 27 and connects to the second electrode pad 251 and the second conductive layer 23. As a result, the PTC material layer 21 electrically connects to the first electrode pad 241 and the second electrode pad 251 to form a conductive path. As mentioned above, the first electrode pad 241 connects to the Vbus pin of the terminal 12, and the second electrode pad 251 connects to a power line. Accordingly, the conductive path supplied by the power line goes through the PTC material layer 21 to form a PTC resistor in the conductive path. When over-current occurs in the connector 10, the PTC material layer 21 in the conductive path trips to be of high resistance state to sever a large amount of current. When micro short-circuit occurs in the connector 10, the connector 10 heats up and the PTC material layer 21 senses high temperature to increase its resistance and finally trips to significantly decrease the current flowing therethrough, so as to prevent the connector 10, the associated cable and apparatus from being blown. In other words, the connector 10 provides over-temperature protection caused by, for example, micro short-circuit. For data transmission D− and D+, the upper and lower electrode pads 242 and 252, and the electrode pads 243 and 253 are not in series connection with the PTC material layer 21, and are connected through the conductive connecting members 30 and 31. The first conductive layer 22 and the second conductive layer 23 adjacent to the conductive connecting members 30 and 31 may have notches for isolation. The upper and lower electrode pads 244 and 254 of the GND are not in series connection with the PTC material layer 21 either and are connected through a conductive connecting member 32. Similarly, the notches may be formed in the first conductive layer 22 and the second conductive layer 23 adjacent to the conductive connecting member 32 for isolation. More specifically, the layered circuit substrate 13 is embedded with a PTC material layer 21 and has surfaces on which a first electrode pad 241 and a second electrode pad 251 are formed. The PTC material layer 21 electrically connects to the first electrode pad 241 and the second electrode pad 251 to form a bus interface circuit for power supply. The electrode pad 244 and the electrode pad 254 connect to ground to form a power return circuit. The PTC material layer is excluded in the power return circuit. The insulating layers 26 and 27 are laminated between the first and second electrode pads 241 and 251 and the PTC material layer 21. The PTC material layer 21 forms a PTC resistor in series connection between the first electrode pad 241 and the second electrode pad 251.

Figure 3:
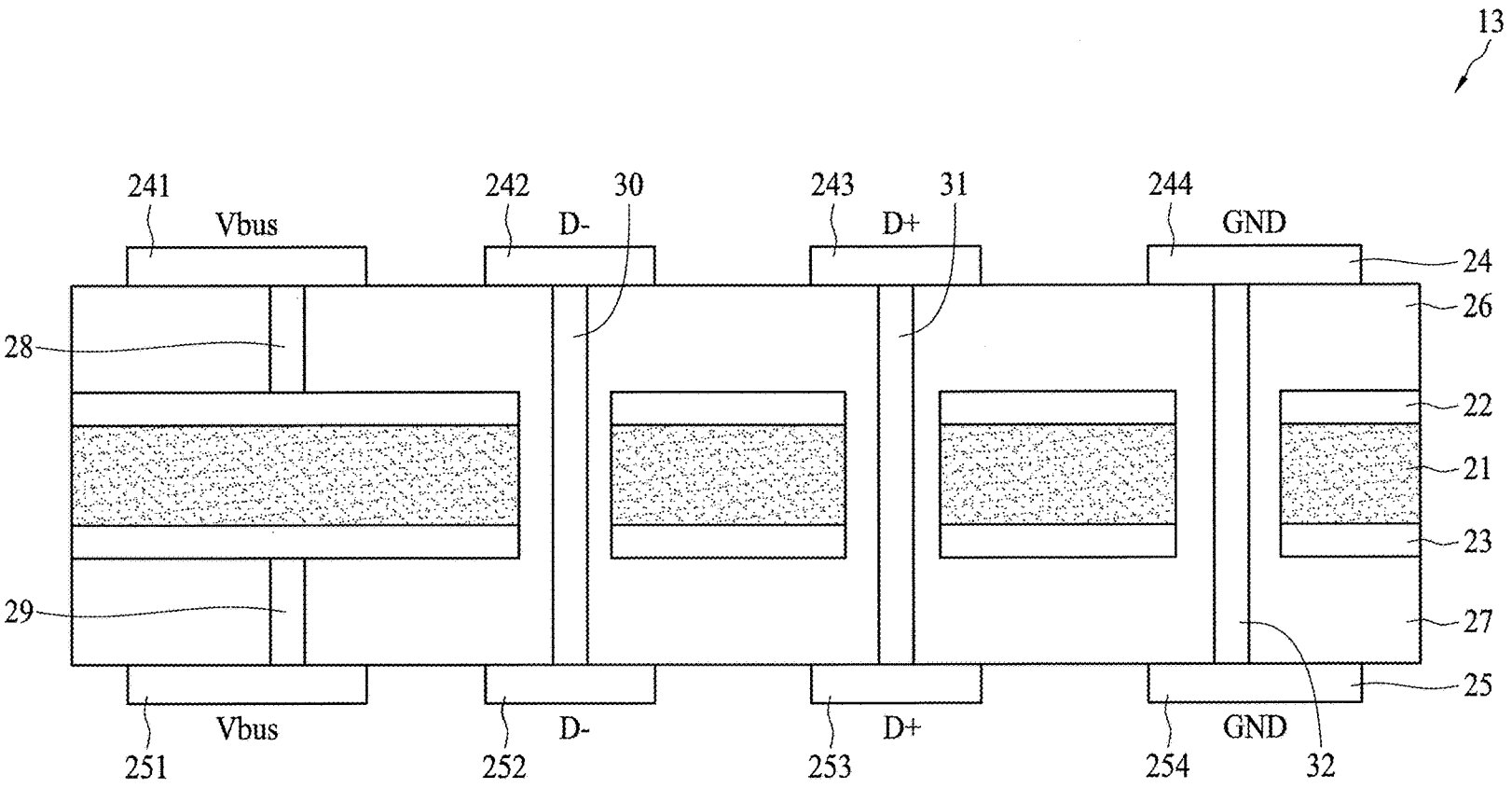
FIG. 3 shows a cross-sectional view of a layered circuit substrate of a connector in accordance with another embodiment of the present application.

FIG. 3 shows a cross-sectional view of the layered circuit substrate 13 in accordance with another embodiment of the present application. Unlike the case shown in FIG. 2, the PTC material layer 21 does not contact the D−, D+ and GND conductive connecting members 30, 31 and 32. That is, the PTC material layer 21 is isolated from the conductive connecting members 30, 31 and 32 by the notches in the PTC material layer 21, which are associated with the notches of the first conductive layer 22 and the second conductive layer 23 for better insulation.

Figure 4:
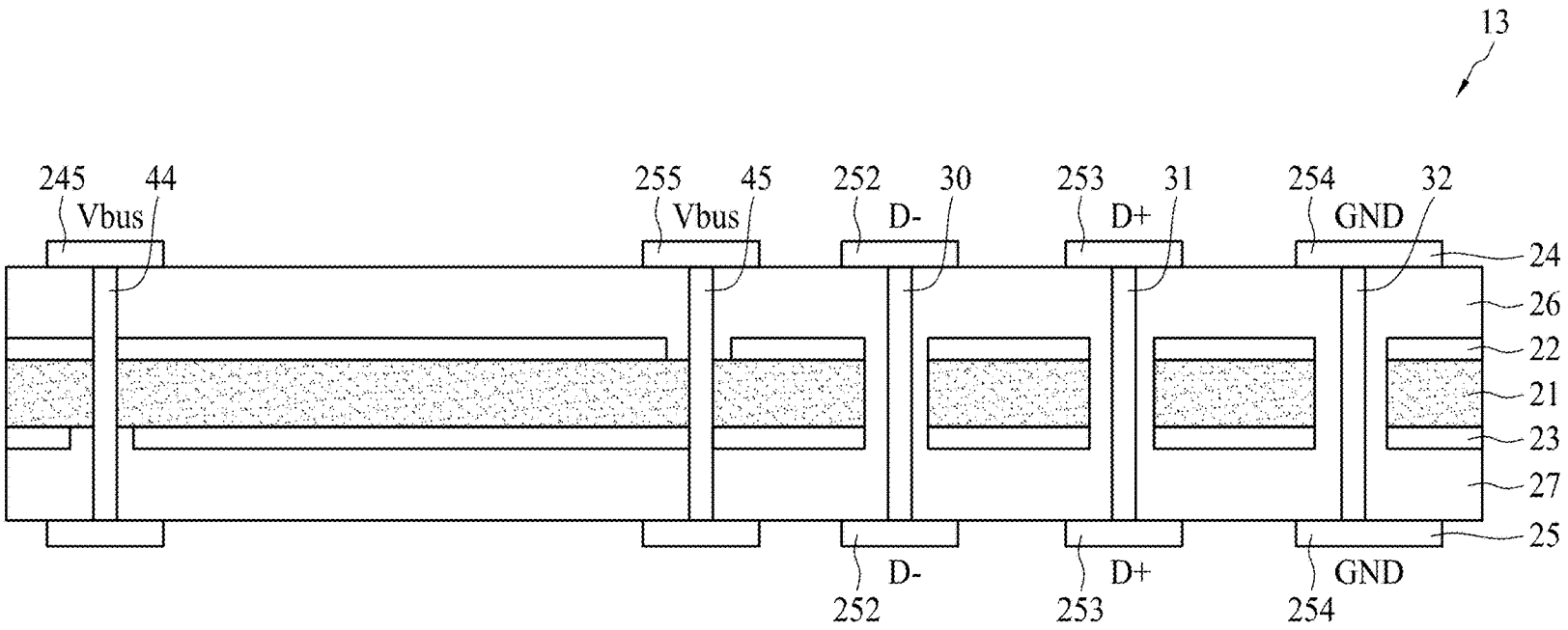
FIG. 4 shows a cross-sectional view of a layered circuit substrate of a connector in accordance with yet another embodiment of the present application.

In practice, the layered circuit substrate 13 is not restricted to the cases in which the first electrode pad 241 and second electrode pad 251 are disposed at different sides of the layered circuit substrate 13 as shown in FIG. 2 and FIG. 3. The first electrode pad 241 and the second electrode pad 251 may be formed on the same side of the layered circuit substrate 13 by designing new circuit connection in the layered circuit substrate 13. FIG. 4 shows another embodiment that the first and second electrode pads of Vbus are formed on the same side of the layered circuit substrate 13. FIG. 4 shows a cross-sectional view of the layered circuit substrate 13, in which D−, D+ and GND are similar to those shown in FIG. 3. The layered circuit substrate 13 extends horizontally and comprises a PTC material layer 21, a first conductive layer 22, a second conductive layer 23, a first electrode layer 24, a second electrode layer 25, a first insulating layer 26 and a second insulating layer 27. Different from the designs of FIG. 2 and FIG. 3, the first conductive connecting member 44 and the second conductive connecting member 45 penetrates through the first insulating layer 26, the first conductive layer 22, the PTC material layer 21, the second conductive layer 23 and the second insulating layer 27. The first conductive connecting member 44 connects to the first electrode pad 245 and the first conductive layer 22, and is isolated from the second conductive layer 23. The second conductive connecting member 45 connects to the second electrode pad 255 and the second conductive layer 23, and is isolated from the first conductive layer 22.

In summary, the first conductive connecting member 28 or 44 electrically connects to the first electrode pad 241 or 245 and the first conductive layer 22. The second conductive connecting member 29 or 45 electrically connects to the second electrode pad 251 or 255 and the second conductive layer 23. The first and second electrode layers 24 and 25 comprise the two Vbus electrode pads in series connection with the PTC material layer 21 to form a PTC resistor, thereby providing over-current and over-temperature protections. In FIGS. 2 to 4, the first and second conductive layers 22 and 23, excluding notch areas near the conductive connecting members 30, 31 and 32, are effective areas of the conductive path going through the PTC material layer 21. More specifically, the effective areas are the overlap portion of the PTC material layer 21 and the first and second conductive layers 22 and 23. The effective area of the PTC material layer 21 is close to the entire area of the layered circuit substrate 13. According to resistance formula, the larger the electrode effective area, the smaller the resistance is. Because the PTC material layer 21 has much larger area compared to a single PTC passive device, lower resistance can be achieved.

The PTC material layer 21 may comprise crystalline polymer and conductive fillers dispersed therein. The crystalline polymer of the PTC material layer 21 may include polyolefin such as polyethylene. The conductive filler may comprise carbon black to obtain high voltage endurance and resistance recovery. However, if accommodating space is insufficient, the effective area of the PTC material layer would be not large enough to obtain low resistance. Alternatively, PTC conductive composite material comprising metal or conductive ceramic fillers may be used to obtain lower resistance than the use of carbon black.

Figure 5:
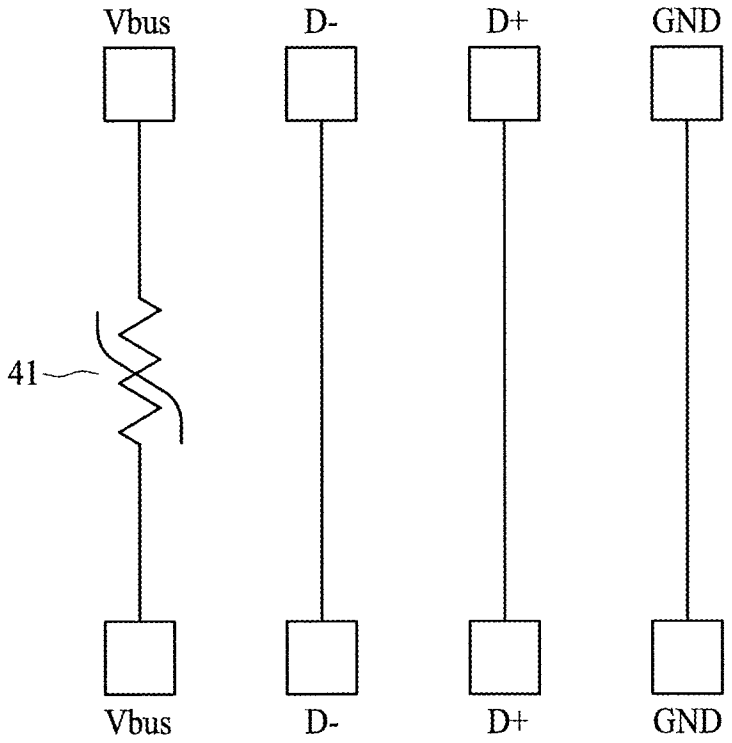
FIG. 5 shows a circuit diagram of a connector in accordance with an embodiment of the present application.

In the conductive path, the PTC material layer 21 serves as a PTC resistor between the first electrode pad 241 and the second electrode pad 251, or the first electrode pad 245 and the second electrode pad 255. Accordingly, a PTC resistor 41 is in series connection in Vbus path, as shown in FIG. 5. When over-current or over-temperature occurs in the Vbus path, the PTC resistor 41 in series connection in the power supply path of the connector 10 trips to be of high resistance state so as to provide over-current and over-temperature protections.

Figure 6:
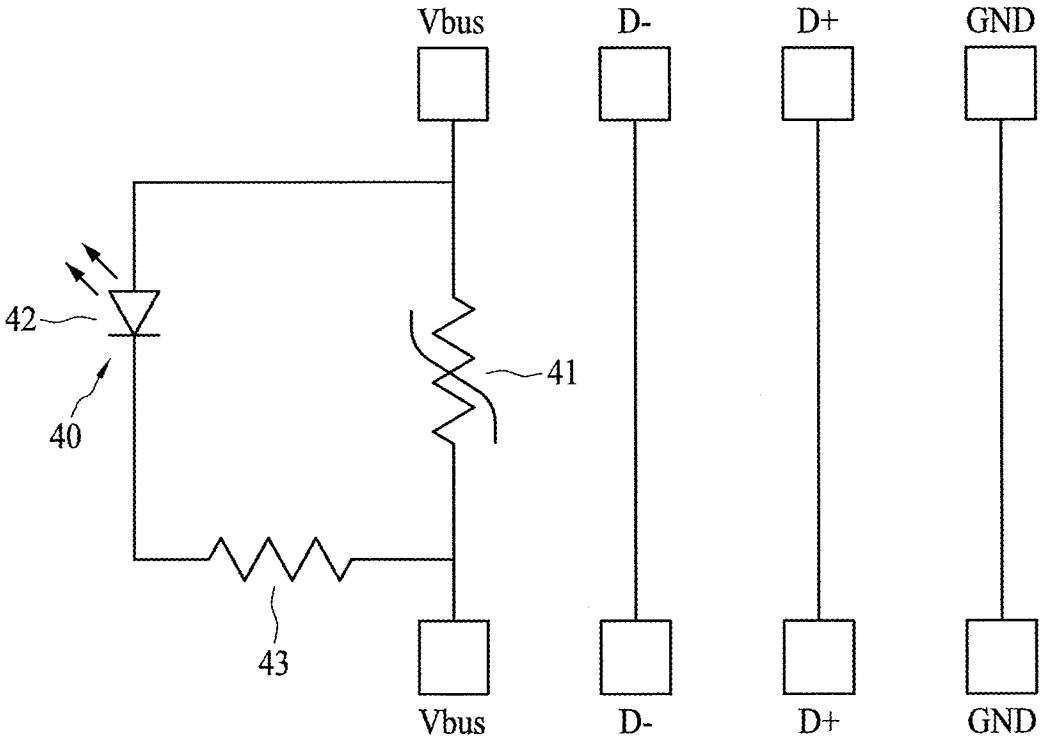
FIGS. 6 to 8 show other circuit diagrams of connectors in accordance with other embodiments of the present application.

In addition to over-current and over-temperature protections by means of series connection of a PTC resistor 41, the users may disconnect power supply line to avoid burnout when they receive alarm messages, as mentioned below. In FIG. 6, an alarm device 40 is further added in the Vbus path. In an embodiment, the alarm device 40 may be an LED device 42. The alarm device 40 and the PTC resistor 41 are in parallel connection. Preferably, the LED device 42 may be in series connection with a resistor 43 for current limitation. The resistor 43 may be a fixed resistor or a PTC thermistor. The LED device 42 and the PTC resistor 41 are in parallel connection. When the PTC resistor 41 is of low resistance, the LED device 42 is not activated because of low voltage across the LED device 42. When the PTC resistor 41 switches to high resistance due to over-current or over-temperature, the voltage across the LED device 42 will increase to a value larger than a threshold voltage of the LED device 42. As a result, current shunts to and lights the LED device 42. Referring to FIG. 1 again, an opening may be formed in the housing 11 corresponding to the position of the LED device 42. Accordingly, the light emitted by the LED device 42 can go through the housing 11 to warn the users.

Figure 7:
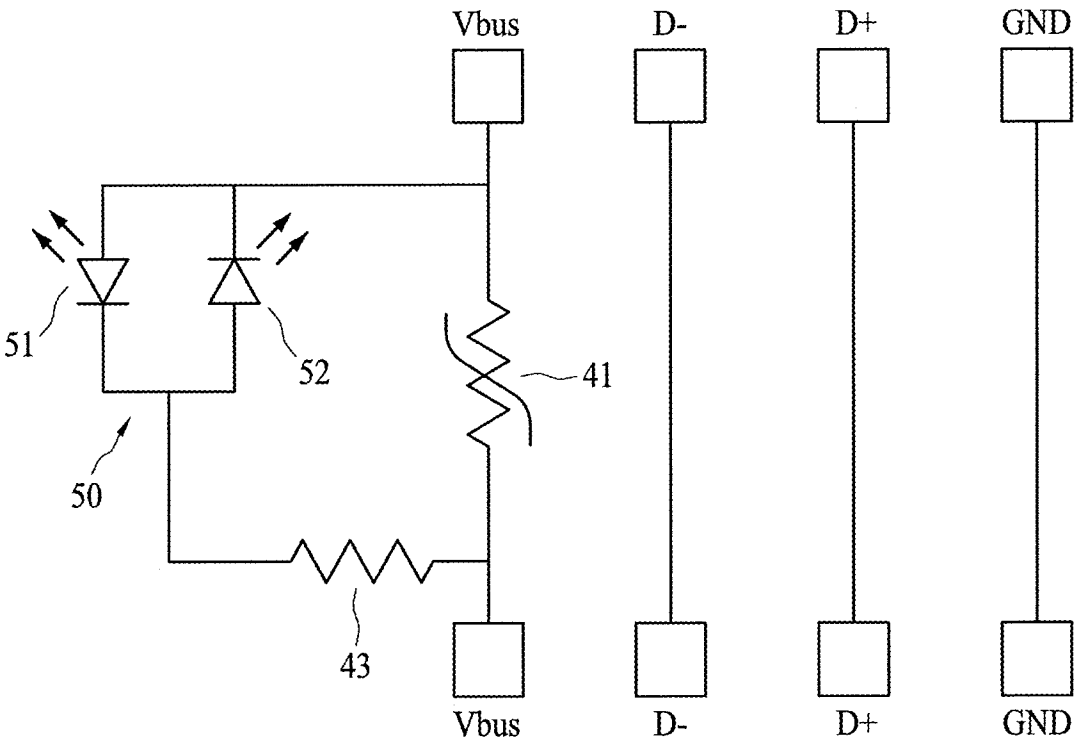

Because the LED device 42 shown in FIG. 6 has polarity, it is needed to consider the direction of the layered circuit substrate to avoid erroneous installation. In a USB Type-C cable, the connector for power supply and the connector for charging are the same. If the LED device 42 has direction limitation, the LED device 42 may not light up after the PTC resistor 41 trips due to connection of the USB cable in an erroneous direction. In FIG. 7, an alarm device 50 contains two LED devices 51 and 52 of opposite polarities. Regardless of the installation directions of the layered circuit board or the connection direction of the cable, current shunts to one of the LED devices 51 and 52 when the PTC resistor 41 switches to a high resistance state due to over-current or over-temperature. Accordingly, the LED device 51 or the LED device 52 lights up to warn the users.

Figure 8:
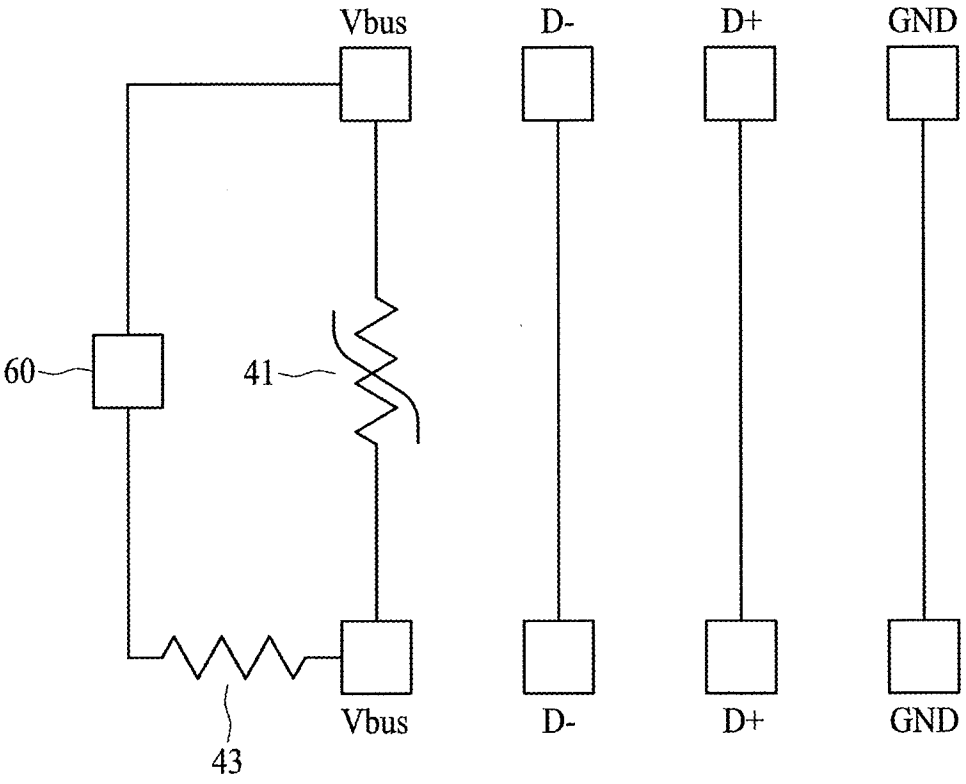

In addition to the use of LED device as an alarm device, other alarm devices, e.g., a beeper, may be used also. In FIG. 8, the beeper 60 and the PTC resistor 41 are connected in parallel. When the PTC resistor 41 changes to a high resistance state due to over-current or over-temperature occurrence, current shunts to the beeper 60. As a result, the beeper 60 sounds to warn the users.

The above-mentioned layered circuit substrate of the connector comprises but not limited to a single PTC resistor. Multiple PTC material layers may be employed to form multiple PTC resistors in parallel connection, so as to decrease the resistance. The connecting manners of multiple PTC material layers are disclosed in published patents and can be easily understood by the people having ordinary skill in the art; therefore the details are not repeated herein.

The connectors of the present application include but not limited to the above embodiments of USB 2.0, other types USB 3.0, USB 3.1 and USB Type-C are covered by the scope of the present application. More specifically, the present application is not limited to the connectors of USB types.

In the present application, the PTC material layer of a large PTC effective area serves as the core of the layered circuit substrate to decrease the resistance, and therefore conductive filler, e.g., carbon black, having high voltage endurance and good resistance recovery may be used to enhance practicability and applicability. The PTC material layer forms a PTC resistor in series connection between the first electrode pad and the second electrode pad in the conductive path of power supply. When an over-current or over-temperature event occurs in the conductive path, the PTC resistor trips instantly to avoid damage caused by, for example, micro short-circuit.

The above-described embodiments of the present invention are intended to be illustrative only. Numerous alternative embodiments may be devised by persons skilled in the art without departing from the scope of the following claims.

What is claimed is:

1. A connector, comprising:

a terminal; and a layered circuit substrate connected to an end of the terminal, the layered circuit substrate comprising a PTC material layer, a first conductive layer, a second conductive layer, a first insulating layer, a second insulating layer, a first electrode layer, a second electrode layer, a first conductive connecting member and a second conductive connecting member, the first electrode layer forming an upper surface of the layered circuit substrate, the second electrode layer forming a lower surface of the layered circuit substrate, the PTC material layer being disposed between the first electrode layer and the second electrode layer, the first electrode layer comprising a first electrode pad and a second electrode pad for power supply, the PTC material layer electrically connecting to the first electrode pad and the second electrode pad to form an electrically conductive path;

wherein the first electrode layer and the second electrode layer further comprise electrode pads for data transmission, and the electrode pads for data transmission are connected through another conductive connecting member isolated from the first conductive layer, the second conductive layer and the PTC material layer;

wherein the first conductive layer is disposed on a surface of the PTC material layer and electrically connects to the first electrode pad, and the second conductive layer is disposed on an opposite surface of the PTC material layer and electrically connects to the second electrode pad;

wherein the first insulating layer is laminated between the first conductive layer and the first electrode layer, and the second insulating layer is laminated between the second conductive layer and the second electrode layer;

wherein the first conductive connecting member and the second conductive connecting member penetrate through the first insulating layer, the PTC material layer and the second insulating layer, the first conductive connecting member connects to the first electrode pad and the first conductive layer and is isolated from the second conductive layer, and the second conductive connecting member connects to the second electrode pad and the second conductive layer and is isolated from the first conductive layer;

wherein the first electrode pad and the second electrode pad are disposed on the same side of the layered circuit substrate; and wherein the PTC material layer forms a PTC resistor in series connection between the first electrode pad and the second electrode pad, and the PTC resistor trips to a high resistance state when over-current or over-temperature occurs in the electrically conductive path.

2. The connector of claim 1, wherein the PTC material layer comprises crystalline polymer and conductive filler, and the conductive filler is selected from the group of carbon black, metal fillers and conductive ceramic fillers.

3. The connector of claim 1, further comprising a warning device in parallel connection with the PTC resistor, current flows through the warning device to generate a warning message when the PTC resistor trips to the high resistance state.

4. The connector of claim 3, wherein the warning device comprises an LED device.

5. The connector of claim 3, wherein the warning device comprises two LED devices connected in parallel, and the two LED devices have opposite polarities.

6. The connector of claim 3, wherein the warning device comprises a beeper.

7. A connector, comprising:

a terminal; and a layered circuit substrate connected to an end of the terminal, the layered circuit substrate being embedded with a PTC material layer, the layered circuit substrate having surfaces provided with a first electrode pad, a second electrode pad, a third electrode pad and a fourth electrode pad, the PTC material layer electrically connecting to the first electrode pad and the second electrode pad to form a bus interface circuit for power supply, the third electrode pad and the fourth electrode pad connecting to ground to form a power return circuit in which the PTC material layer is excluded, the PTC material layer being isolated from the power return circuit, at least one insulating layer being laminated between the first and second electrode pads and the PTC material layer;

wherein the surfaces of the layered circuit substrate are further provided with other electrode pads for data transmission, and the electrode pads for data transmission are connected through a conductive connecting member isolated from the PTC material layer;

wherein the PTC material layer forms a PTC resistor in series connection between the first electrode pad and the second electrode pad, and the PTC resistor trips to a high resistance state when over-current or over-temperature occurs in the electrically conductive path.

8. The connector of claim 7, further comprising a warning device in parallel connection with the PTC resistor, current flows through the warning device to generate a warning message when the PTC resistor trips to the high resistance state.

* * * * *